US011554289B2

(12) United States Patent
Ross

(10) Patent No.: US 11,554,289 B2
(45) Date of Patent: Jan. 17, 2023

(54) ROWING MACHINE EXERCISE DEVICE

(71) Applicant: Exemplar Design, LLC, Mason, OH (US)

(72) Inventor: Adam L. Ross, Loveland, OH (US)

(73) Assignee: Exemplar Design, LLC, Mason, OH (US)

( * ) Notice: Subject to any disclaimer, the term of this patent is extended or adjusted under 35 U.S.C. 154(b) by 198 days.

(21) Appl. No.: 16/813,019

(22) Filed: Mar. 9, 2020

(65) Prior Publication Data

US 2021/0275858 A1 Sep. 9, 2021

(51) Int. Cl.

| | |
|---|---|
| ***A63B 22/00*** | (2006.01) |
| ***A63B 21/00*** | (2006.01) |
| ***A63B 23/12*** | (2006.01) |

(52) U.S. Cl.

CPC ..... *A63B 22/0076* (2013.01); *A63B 21/153* (2013.01); *A63B 22/0015* (2013.01); *A63B 22/0087* (2013.01); *A63B 23/12* (2013.01); *A63B 2022/0079* (2013.01); *A63B 2225/09* (2013.01)

(58) Field of Classification Search

CPC ..... A63B 2208/0295; A63B 2220/00; A63B 2220/10; A63B 2220/16; A63B 2220/17; A63B 2220/18; A63B 2220/20; A63B 2220/22; A63B 2220/24; A63B 2220/30; A63B 2220/31; A63B 2220/34; A63B 2220/35; A63B 2220/36; A63B 2220/40; A63B 2220/44; A63B 2220/50; A63B 2220/51; A63B 2220/52; A63B 2220/53; A63B 2220/54; A63B 2220/56; A63B 2220/58; A63B 2220/62; A63B 2220/64; A63B 2220/80; A63B 2220/803; Y10T 403/32483; Y10T 403/32475; F16B 7/105

USPC ..... 482/72

See application file for complete search history.

(56) References Cited

U.S. PATENT DOCUMENTS

| | | | | | |
|---|---|---|---|---|---|
| 4,705,267 | A | * | 11/1987 | Jackson | A63B 21/4029 482/106 |
| 5,029,848 | A | * | 7/1991 | Sleamaker | A63B 21/0628 482/96 |
| 5,470,295 | A | * | 11/1995 | Wang | A63B 21/068 482/96 |
| 5,514,053 | A | * | 5/1996 | Hawkins | A63B 21/15 601/36 |
| 5,658,225 | A | | 8/1997 | Huang | |

(Continued)

*Primary Examiner* — Megan Anderson
*Assistant Examiner* — Thao N Do
(74) *Attorney, Agent, or Firm* — BakerHostetler

(57) ABSTRACT

A rowing machine exercise device includes a vertically adjustable rear support base. The vertically adjustable rear support base includes an outer vertical support beam extending down from the rowing machine frame; an inner vertical support beam received in a telescoping manner within the outer support beam through the bottom of the outer support beam; a latch pin assembly mounted to the outer vertical support beam, where the latch pin assembly includes a latch pin biased to extend through the latch pin hole and any of the adjustment holes that are vertically aligned with the latch pin hole, and where the latch pin assembly includes an actuating tab that overcomes the bias to pull the latch pin from the vertically aligned adjustment hole when actuated; and a lift handle mounted to or part of the outer vertical support beam and/or the rowing machine frame.

1 Claim, 5 Drawing Sheets

(56) References Cited

U.S. PATENT DOCUMENTS 6,981,932 B1 1/2006 Huang et al.
7,108,639 B2 9/2006 Smith et al.
7,381,164 B2 6/2008 Smith et al.
8,043,172 B2 * 10/2011 Campanaro ..... A63B 69/0097 273/395
8,808,152 B1 * 8/2014 Midgett ..... A63B 23/03541 482/146
D741,420 S * 10/2015 Campanaro ..... D21/674
9,750,972 B1 * 9/2017 Liu ..... A63B 22/20
10,420,980 B2 9/2019 Wu
D914,812 S * 3/2021 Campanaro ..... D21/674
2005/0130810 A1 * 6/2005 Sands ..... A63B 21/0552 482/72
2007/0049470 A1 3/2007 Pyles et al.
2009/0203503 A1 * 8/2009 Gothro ..... A63B 69/06 482/72
2010/0227748 A1 * 9/2010 Campanaro ..... A63B 21/068 482/140
2014/0005006 A1 * 1/2014 Ho ..... A63B 22/14 482/96
2014/0005007 A1 * 1/2014 Ho ..... A63B 21/068 482/96
2015/0057130 A1 * 2/2015 Lin ..... A63B 21/225 482/72
2016/0001123 A1 * 1/2016 Parrish, Jr. ..... A63B 22/0076 482/142
2016/0107023 A1 * 4/2016 Campanaro ..... A63B 22/0089 482/72
2016/0279464 A1 * 9/2016 Liu ..... A63B 21/4047
2018/0056118 A1 * 3/2018 Bates ..... A63B 21/153
2018/0126216 A1 * 5/2018 Hamilton ..... A63B 21/151
2018/0214734 A1 * 8/2018 Lammers ..... A63B 21/225
2018/0272182 A1 * 9/2018 Hou ..... A63B 22/0076
2019/0168051 A1 * 6/2019 Hausheer ..... A63B 71/0036
2019/0192899 A1 * 6/2019 Dubin ..... A63B 21/153
2019/0201740 A1 * 7/2019 Robert ..... A63B 22/0076
2019/0262661 A1 * 8/2019 Stepanian ..... A63B 21/225
2020/0197739 A1 * 6/2020 Hsieh ..... A63B 69/06
2020/0282256 A1 * 9/2020 Boyles ..... A63B 21/4001

* cited by examiner

ROWING MACHINE EXERCISE DEVICE

BACKGROUND

The current disclosure relates to a rowing machine exercise device; and more particularly, to a rowing machine exercise device with vertical height adjustability.

SUMMARY

It is an aspect of the current disclosure to provide a rowing machine exercise device with height adjustability in a rear-end support.

In an aspect, the rowing machine exercise device includes a rowing machine frame having a forward support base and a rear support base; a flywheel rewinder mounted to the rowing machine frame; a pull rope attached to the flywheel rewinder at a first end and attached to a pull bar at an opposite end; at least one footrest panel mounted to the rowing machine frame; and a seat mounted for reciprocating movement along the rowing machine frame towards and away from the footrest panels. The rear support base is vertically adjustable and includes an outer vertical support beam coupled to and extending down from the rowing machine frame, where the outer vertical support beam has a vertical channel extending upward therein from a bottom of the outer vertical support beam and has a latch pin hole extending through a wall of a bottom portion of the vertical support beam; an inner vertical support beam received in a telescoping manner within the outer support beam through the bottom of the outer support beam, where the inner vertical support beam has a plurality of adjustment holes uniformly spaced along a vertical line in an outer wall of the inner vertical support beam, and where the vertical line is horizontally aligned with the latch pin hole in the outer vertical support beam; a foot structure coupled to the bottom of the inner vertical support beam; a latch pin assembly mounted to the outer vertical support beam, where the latch pin assembly includes a latch pin biased to extend through the latch pin hole and any of the adjustment holes that are vertically aligned with the latch pin hole, and where the latch pin assembly includes an actuating tab that overcomes the bias to pull the latch pin from the vertically aligned adjustment hole when actuated; and a lift handle mounted to the outer vertical support beam and/or the rowing machine frame.

In a more detailed aspect, the latch pin assembly includes a lever pivotally mounted to the outer vertical support beam, where the lever has an actuating end that includes the actuating tab and an opposite engagement end that includes the latch pin. In a specific embodiment, the lever is generally Z-shaped in cross section taken along the vertical line. In such a Z-shaped embodiment, the actuating tab comprises the upper horizontal extent of the Z-shape, the latch pin comprises the lower horizontal extent of the Z-shape, and the intermediate vertical extent of the Z-shape is the portion that is connected to the pivot and to the bias. In a more detailed aspect, the lever is at least partially contained in a housing mounted to the outer vertical support beam, where the housing includes an outer wall, and where the bias is a spring positioned between the outer wall of the housing and a portion of the lever approximate the latch pin.

Alternately or in addition, the plurality of adjustment holes includes a bottom-most and a top-most hole, where the latch pin hole is vertically aligned with the bottom-most hole when the inner vertical support beam is fully received within the outer vertical support beam. Alternatively or in addition, the device includes at least five of the adjustment holes.

DETAILED DESCRIPTION

Figure 1:
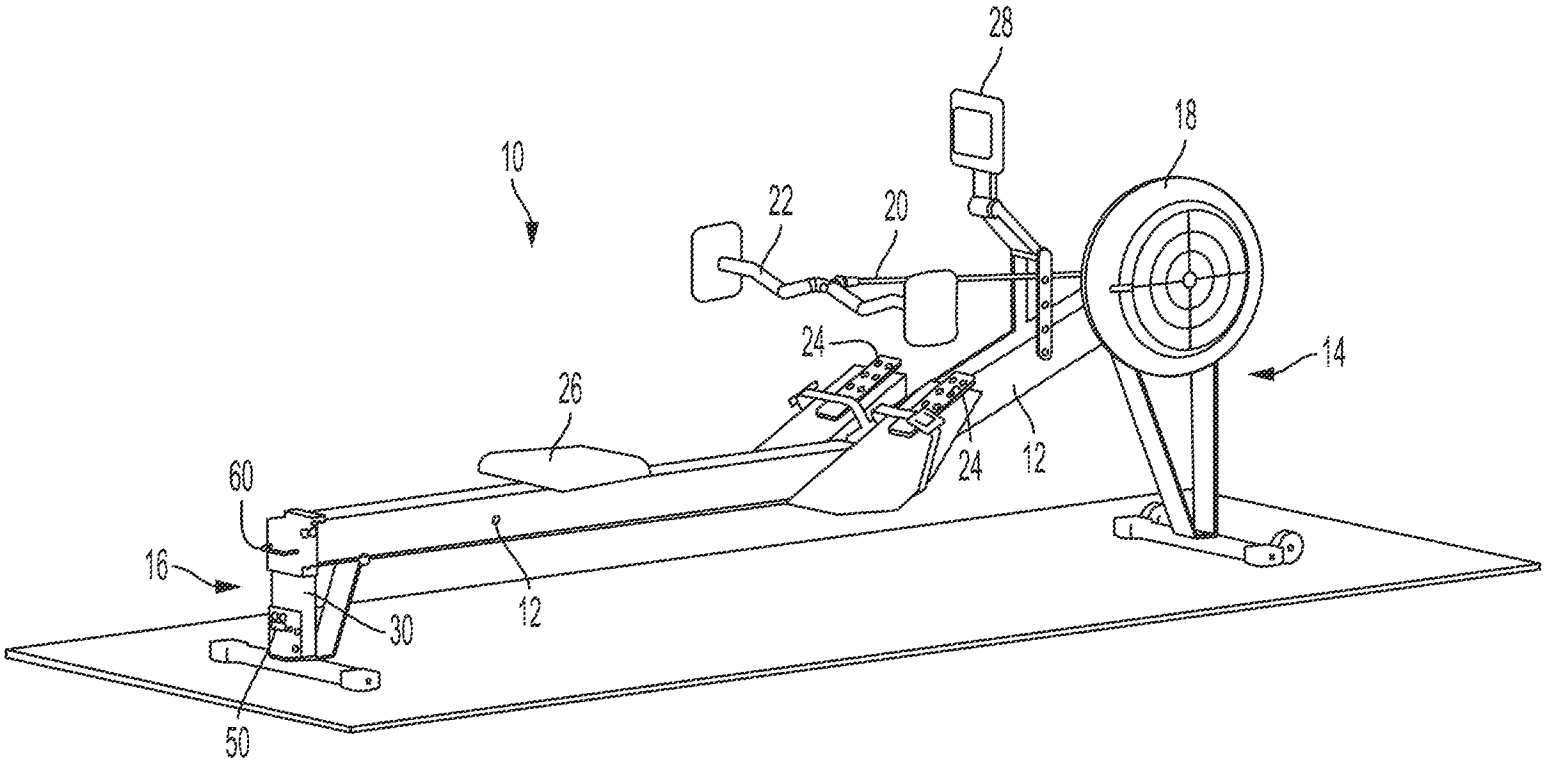
FIG. 1 is a perspective view of a rowing machine with an exemplary vertical height adjustment mechanism according to the current disclosure.
Figure 2A:
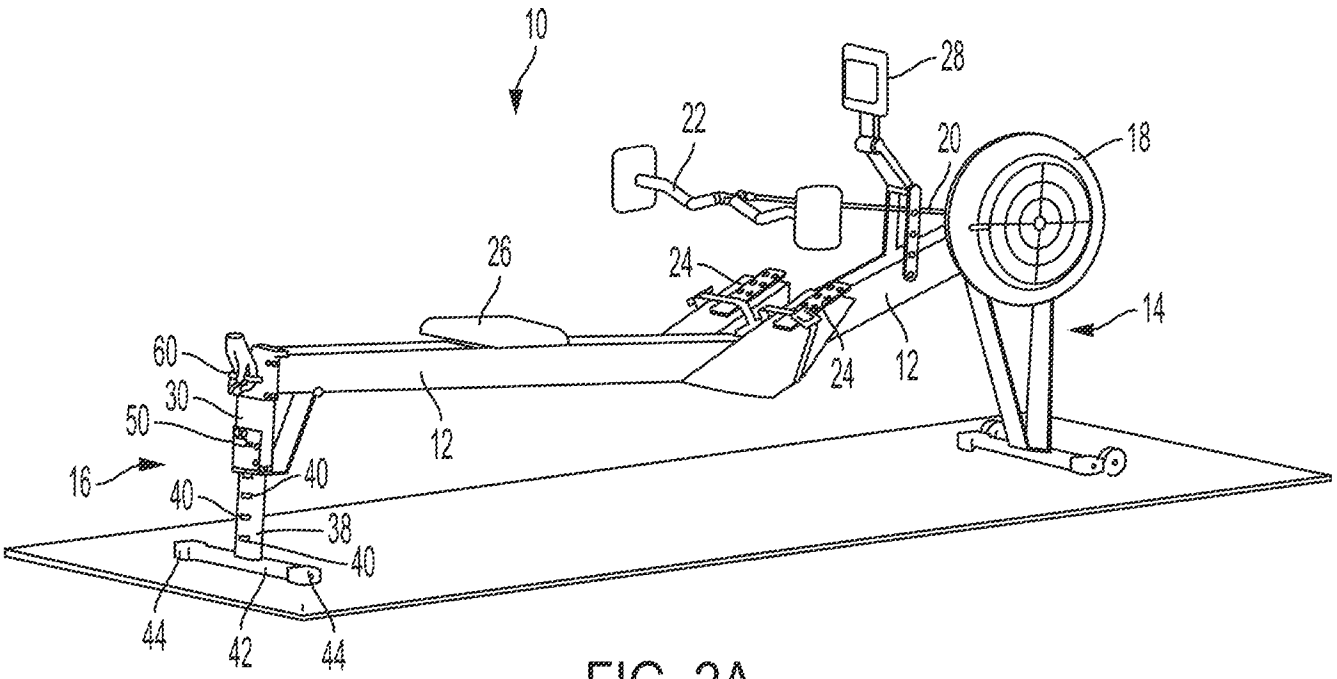
FIG. 2A is perspective view of the rowing machine of FIG. 1 where the vertical height adjustment mechanism is extended to a higher vertical position.
Figure 2B:
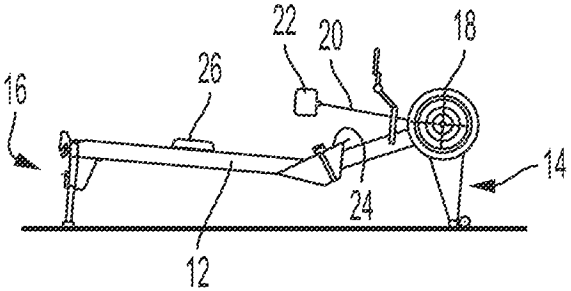
FIG. 2B is a side elevational view of FIG. 2A.

As shown in FIGS. 1-2B, an exemplary embodiment of the rowing machine 10 includes a rowing machine frame 12 having a forward support base 14 and a rear support base 16. A flywheel rewinder 18 is mounted to the machine frame 12 and includes a pull rope 20 extending therefrom where the user-end of the pull rope is attached to a pull bar 22, and where the pull bar 22 includes a pair of handgrips for the user. The frame 12 further includes a pair of footrest panels 24 for seating the user's feet thereon in use, and includes a seat 26 mounted for reciprocating movement along the rowing machine frame 12 towards and away from the footrest panels 24. The rowing machine 10 may further include an electronic display 28 for providing information pertaining to an exercise session and for allowing the user to input various controls such as, for example, adjusting the resistance of the rewinder 18.

Referring to FIGS. 2A-3B, the rear support base 16 is vertically adjustable. The vertically adjustable rear support base 16 includes an outer vertical support beam 30 coupled to and extending down from the rowing machine frame 12. The outer vertical support beam includes a vertical channel 32 extending upward therein from a bottom 34 of the vertical support beam. Also near the bottom 34 of the outer vertical support beam is a latch pin hole 36 extending through the outer wall of the outer vertical support beam. The rear support base 16 also includes an inner vertical support beam 38 received in a telescoping manner within the outer support beam channel 32 through the bottom 34 of the outer support beam 30. The inner vertical support beam 38 includes a plurality of adjustment holes 40 uniformly spaced along a vertical line in an outer wall of the inner vertical support beam 38, where the vertical line is horizontally aligned with the latch pin hole 38 in the outer vertical support beam 30. A foot structure 41 is coupled to the bottom of the inner vertical support beam 40 and includes a horizontal bar 42 with a pair of rubber feet 44 mounted to the ends of the horizontal bar 42.

A latch pin assembly 46 includes a lever 48 pivotally mounted to the outer vertical support beam 30 where the lever has an actuating end that includes an actuating tab 50 and an opposite engagement end that includes a latch pin 52. The lever 48 is pivotally mounted on a pivot pin 54 and the latch pin assembly also includes a spring 56 operative to engage the lever so that the latch pin 52 is biased into engagement with the latch pin hole 36 and one of the vertically aligned adjustment holes 40. Upward pressure on the latch pin tab 50 pivots the lever on pivot pin 54 and operates to overcome the bias of spring 56 to pull/pivot the latch pin 52 from the vertically aligned adjustment hole 40 when actuated.

Figure 3B:
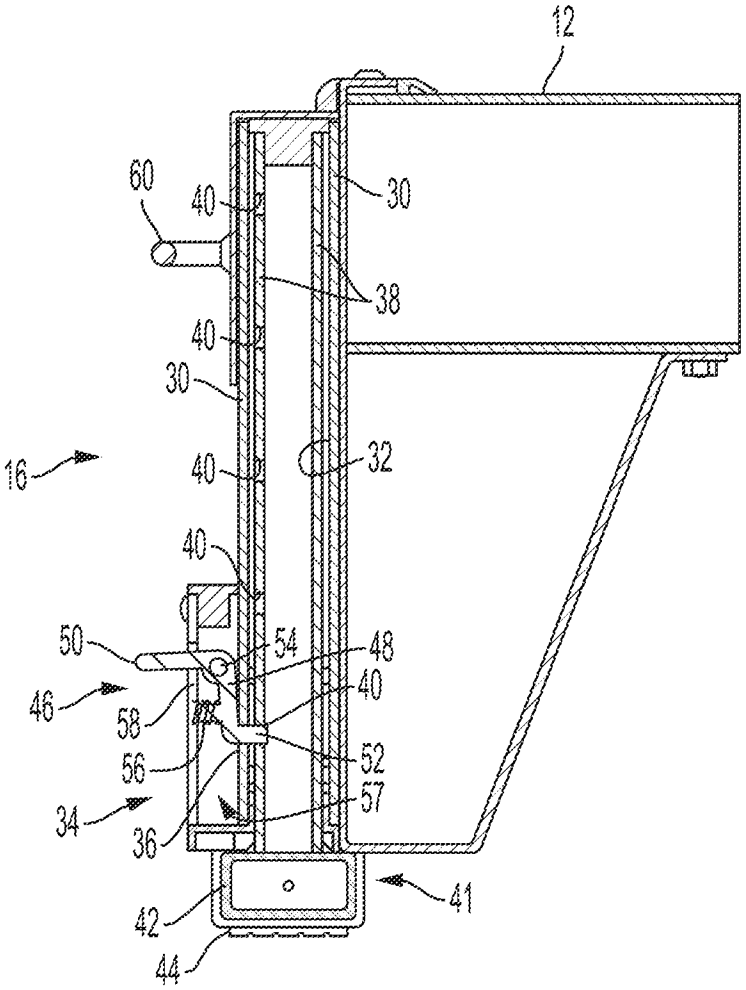
FIG. 3B is a cross-sectional view of the exemplary vertical height adjustment mechanism taken along lines B-B of FIG. 3A.
Figure 3A:
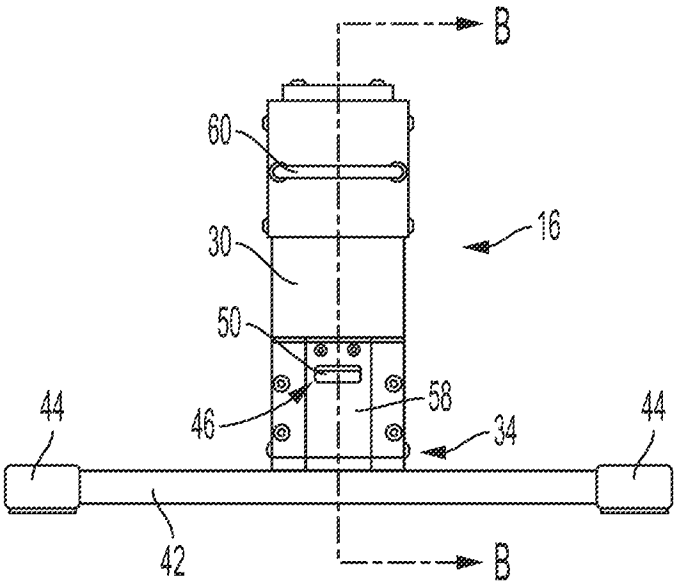
FIG. 3A is an elevational view of the exemplary vertical height adjustment mechanism taken from a rear end of the rowing machine.

As shown in FIG. 3, the lever is generally Z-shaped in cross section, where the upper horizontal segment of the Z-shape includes the actuating tab 50 and the lower horizontal segment of the Z-shape includes the latch pin 52. In this embodiment, the pivot pin 54 is positioned at the intersection of the upper horizontal segment of the Z-shape and the vertical segment of the Z-shape. The lever 48 is at least partially contained in a housing 57 mounted to the outer vertical support beam 30. The housing 57 includes an outer wall 58, and the spring is positioned between the outer wall 58 and a portion of the vertical segment of the Z-shape approximate the latch pin 40.

A lift handle 60 is mounted to the outer vertical support beam 30 near a top of the outer vertical support beam.

As shown in FIG. 3B, the latch pin hole 36 is vertically aligned with the bottom-most adjustment hole 40 when the inner vertical support beam 38 is fully received within the cavity 32 of the outer vertical support beam 30. In an embodiment, the latch pin hole 36 and the adjustment holes 40 are oblong—horizontally longer than their vertical height (the oblong adjustment holes 40 are best shown in FIG. 2A)—and the latch pin 52 is likewise correspondingly oblong (but, of course, sized to fit securely in the holes 36/40). Such a horizontally wider oblong shape may allow the latch pin 52, and in turn the adjustable rear support base 16, to support more weight.

Figure 4:
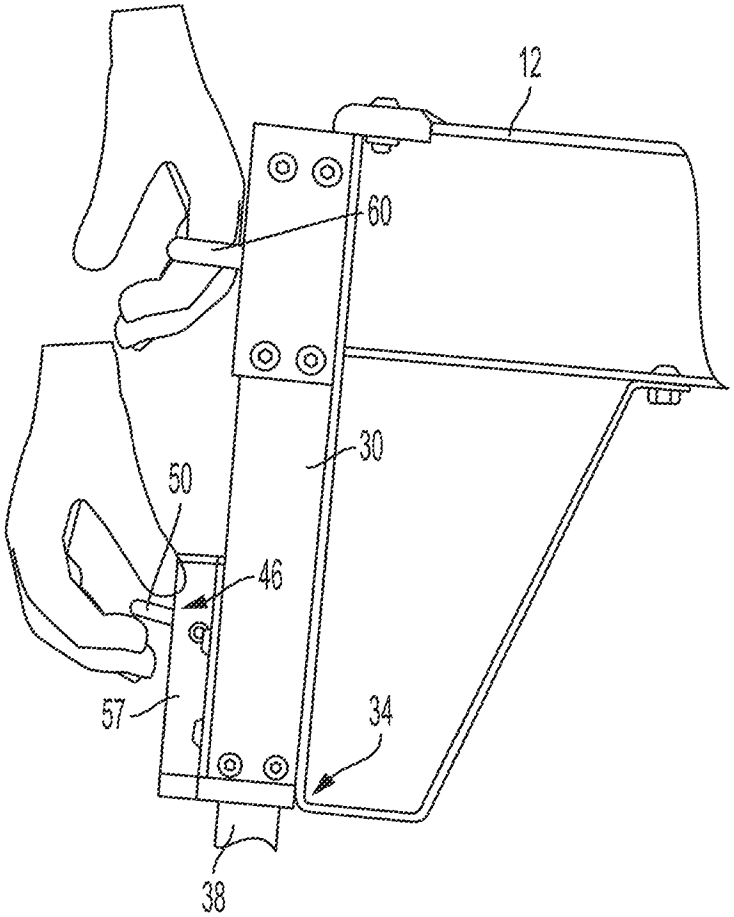
FIG. 4 is a side view of the exemplary vertical height adjustment mechanism illustrating how to manually adjust the vertical height of the rear end of the rowing machine.
Figure 5:
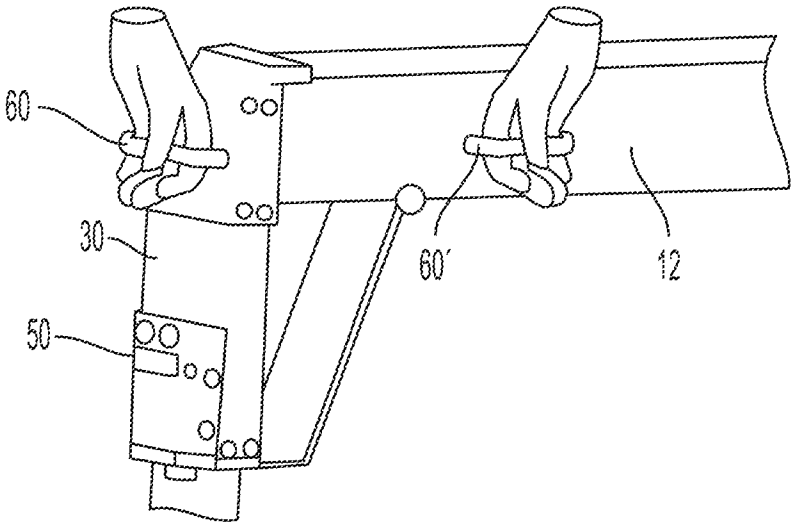
FIG. 5 is a perspective view illustrating an alternative embodiment in which a lift handle is mounted to the outer vertical support beam and/or the rowing machine frame.

As shown in FIG. 4, to adjust the vertical elevation of the rear support base 16, a user pulls up on the adjustment tab 50, which causes the latch pin 52 of the lever 48 to be removed from the adjustment hole 40 and then the user grips the lift handle 60 and vertically adjusts the telescoping between the outer vertical support beam 30 and the inner vertical support beam 38 when the latch pin is not engaged with any of the adjustment holes 40. Then when the desired height is achieved, the user will allow the latch pin hole 36 and adjustment hole 40 approximate that position to be vertically aligned and will then release the actuating tab 50 to allow the latch pin 52 to be received within the aligned latch pin hole 36 and adjustment hole 40 at approximate the desired height.

As shown in FIG. 2B, when the exemplary vertically adjustable rear support base 16 is set at its highest vertical adjustment (the latch pin 52 is engaged with the top-most adjustment hole 40), the portion of the frame 12 on which the seat 26 reciprocates back and forth is angled at 5° with respect to the floor.

Having described the embodiments of the current disclosure by reference to the attached drawings, it will be apparent to those of ordinary skill that modifications may be made to the embodiments without departing from the scope of any invention as recited in any of the appended claims. For example, the vertically adjustable rear support base 16 may be incorporated into different rowing machine exercise device designs not depicted in this disclosure. For example, some rowing machine exercise devices do not use a flywheel rewinder. For example, some rowing machine exercise devices utilize magnetic resistance, mechanical resistance, pneumatic resistance and the like. Further, some rowing machine exercise devices do not include a pull rope 20 attached to a rewinder. For example, some rowing machine exercise devices utilize a pair of handlebars that are each pivotally connected to the rowing machine frame and associated with some sort of resistance mechanism controlling the physical exertion required to pivot the handlebars on the rowing machine frame. Some rowing machine exercise devices may be contemplated as for home use while other exemplary rowing machine exercise devices may be contemplated for professional use. As another example, the latch pin assembly 46 may have a different orientation or arrangement so that the actuating tab may be toggled downwardly or to the side to disengage the latch pin 52, rather than toggling upward. As another example, the handle 60 may be provided on the frame 12 or may be incorporated into the outer vertical support 30 or the frame 12 as, for example, a horizontal edge (extending inward or outward) that may be gripped by a user. Specifically, as shown in FIG. 6, a lift handle 60 may be mounted to the outer vertical support 30 and/or a handle 60' may be mounted to the rowing machine frame 12. As another example, the inner vertical support beam 38 may extend down from the frame 12 while the outer vertical support beam may include the foot structure 41. As another example, the foot structure 41 can have any mechanical structure adapted to contact the floor and support the rear support base 16. As another example, the outer and inner vertical support beams 30/38 may have any corresponding cross sectional shape, such as rectangular (as illustrated), circular, oblong and the like.

What is claimed is:

1. A rowing machine exercise device comprising:

a rowing machine frame having a forward support base and a rear support base;

a rewinder mounted to the rowing machine frame;

a pull rope attached to the rewinder at a first end and attached to a pull bar at an opposite end;

at least one foot rest panel mounted to the rowing machine frame; and a seat mounted for reciprocating movement along the rowing machine frame towards and away from the at least one foot rest panel;

wherein the rear support base is vertically adjustable and includes, an outer vertical support beam coupled to and extending down from the rowing machine frame, having a vertical channel extending upward therein from a bottom of the outer vertical support beam and having a latch pin hole extending through a wall of the outer vertical support beam, an inner vertical support beam received in a telescoping manner within the outer vertical support beam through the bottom of the outer vertical support beam, the inner vertical support beam having a plurality of adjustment holes uniformly spaced along a vertical line in an outer wall of the inner vertical support beam, the vertical line being aligned on a horizontal point with the latch pin hole in the outer vertical support beam, a foot structure coupled to a bottom of the inner vertical support beam, a latch pin assembly mounted to the outer vertical support beam, the latch pin assembly including a latch pin biased by a bias to extend through the latch pin hole and any of the plurality of adjustment holes that are aligned on a vertical level with the latch pin hole, and the latch pin assembly including an actuating tab that overcomes the bias to pull the latch pin from the any of the plurality of adjustment holes that are aligned on the vertical level with the latch pin hole when actuated, and a lift handle mounted to either the outer vertical support beam or the rowing machine frame;

wherein the latch pin assembly includes a lever pivotally mounted to the outer vertical support beam, wherein the lever has an actuating end that includes the actuating tab and an opposite engagement end that includes the latch pin;

wherein the lever is z-shaped in cross-section taken along the vertical line; and wherein the lever is at least partially contained in a housing mounted to the outer vertical support beam, the housing including an outer wall, and the bias comprising a spring positioned between the outer wall of the housing and a portion of the lever approximate the latch pin.

* * * * *